US006767447B2

(12) United States Patent
Uno et al.

(10) Patent No.: US 6,767,447 B2
(45) Date of Patent: Jul. 27, 2004

(54) ELECTROLYTIC CELL FOR HYDROGEN PEROXIDE PRODUCTION AND PROCESS FOR PRODUCING HYDROGEN PEROXIDE

(75) Inventors: Masaharu Uno, Fujisawa (JP); Shuhei Wakita, Fujisawa (JP); Masao Sekimoto, Fujisawa (JP); Tsuneto Furuta, Fujisawa (JP); Yoshinori Nishiki, Fujisawa (JP)

(73) Assignee: Premelec Electrode Ltd., Kanagawa (JP)

( * ) Notice: Subject to any disclaimer, the term of this patent is extended or adjusted under 35 U.S.C. 154(b) by 185 days.

(21) Appl. No.: 10/123,114

(22) Filed: Apr. 17, 2002

(65) Prior Publication Data

US 2002/0153262 A1 Oct. 24, 2002

(30) Foreign Application Priority Data

Apr. 18, 2001 (JP) ..... P. 2001-120063

(51) Int. Cl.[7] ..... C25B 1/30; C02F 1/461

(52) U.S. Cl. ..... 205/466; 205/468; 205/746; 204/263; 204/265

(58) Field of Search ..... 205/466, 468, 205/746; 204/263, 265

(56) References Cited

U.S. PATENT DOCUMENTS 5,647,968 A * 7/1997 Fraser et al. ..... 205/466
5,997,717 A * 12/1999 Miyashita et al. ..... 205/466
6,547,947 B1 * 4/2003 Uno et al. ..... 205/466

* cited by examiner

*Primary Examiner*—Arun S. Phage
(74) *Attorney, Agent, or Firm*—Sughrue Mion, PLLC

(57) ABSTRACT

An electrolytic cell and method of electrolysis for producing hydrogen peroxide at a moderate current density while preventing metal deposition on the cathode surface. A feed water from which multivalent metal ions have been removed and in which a salt of a univalent metal, e.g., sodium sulfate, has been dissolved in a given concentration is prepared with an apparatus for removing multivalent metal ions and dissolving a salt in low concentration. The feed water is supplied to an electrolytic cell. Even when electrolysis is continued, almost no deposition of a hydroxide or carbonate occurs on the cathode because multivalent metal ions are not present in the electrolytic solution. Due to the dissolved salt, a sufficient current density is secured to prevent an excessive load from being imposed on the electrodes, etc. Thus, stable production of hydrogen peroxide is possible over a long period of time.

10 Claims, 1 Drawing Sheet

ELECTROLYTIC CELL FOR HYDROGEN PEROXIDE PRODUCTION AND PROCESS FOR PRODUCING HYDROGEN PEROXIDE

FIELD OF THE INVENTION

The present invention relates to an electrolytic cell and process for producing hydrogen peroxide at a high current efficiency.

DESCRIPTION OF THE RELATED ART

There is concern about adverse influences of pollution by industrial and household wastes, such as air pollution and the deterioration of water quality in rivers and lakes, on the environment and the human body, and there is an urgent need to take technical measures to eliminate those problems. For example, a chemical such as chlorine has been used in the treatment of drinking water, sewage, and wastewater for the purpose of decoloring, COD reduction, and sterilization. However, since large chlorine doses result in the generation of hazardous substances, e.g., environmental hormones (exogenous endocrine disruptors) and carcinogenic substances, the addition of chlorine tends to be prohibited.

The incineration of wastes can generate carcinogenic substances (dioxins) in the emission gas depending on combustion conditions and thereby adversely affect the ecosystem. The safety of waste incineration is hence regarded as questionable. A novel method of water treatment with hydrogen peroxide has been proposed for eliminating the problem concerning water treatments.

Hydrogen peroxide is a chemical suitable for sterilization in such water treatments and the like. Besides being suitable for water treatments, hydrogen peroxide is useful as a basic chemical indispensable to the food, medicine, pulp, textile, and semiconductor industries. Future uses thereof which are attracting particular attention include the cleaning of electronic parts and the sterilization of medical instruments and apparatus.

In power plants and factories where seawater is used, a technique for preventing the attachment of organisms has hitherto been employed which comprises directly electrolyzing seawater to yield hypochlorous acid and effectively utilizing the hypochlorous acid for preventing the attachment of organisms. However, the discharge of untreated hypochlorous acid poses problems concerning environmental conservation because not only hypochlorous acid itself but also the organochlorine compounds and chlorine gas which generate upon decomposition of the acid are harmful. Consequently, use of hypochlorous acid is being increasingly restricted.

On the other hand, it has been reported that addition of a minute amount of hydrogen peroxide to the cooling water for use in power plants or factories is sufficiently effective in preventing the attachment of organisms. In addition, hydrogen peroxide decomposes only into water and oxygen, which both are harmless, to pose no problem to environmental hygiene.

However, hydrogen peroxide is unstable and incapable of long-term storage. Because of this and from the standpoints of safety in transportation and pollution abatement, there is a growing desire for an on-site hydrogen peroxide production apparatus. An electrolytic method has been proposed as a technique for on-site production of hydrogen peroxide.

In the electrolytic method, electrical energy, which is clean, can be used to cause a desired electrochemical reaction. By controlling the chemical reaction on a cathode surface, hydrogen peroxide can be produced. This electrolytically produced hydrogen peroxide has hitherto been widely used to decompose pollutants to thereby treat water for use in a particular application or to treat wastewaters. The electrolytic method enables the on-site production of hydrogen peroxide and eliminates the drawback in that hydrogen peroxide cannot be stored for long periods of time without a stabilizer. In addition, there is no need to take measures against the danger of transportation and pollution.

In the electrolysis of water in which oxygen is present, the reduction reaction of oxygen proceeds preferentially to yield hydrogen peroxide. When an electrolytic liquid itself is to be cleaned or sterilized, the electrolytic liquid comes into direct contact with an electrode to enhance the cleaning effect. There also are cases where superoxide anions ($O_2^-$), which are a highly active product of the reduction of one electron, are generated to improve the cleaning effect.

With respect to the electrolytic production of hydrogen peroxide, *Journal of Applied Electrochemistry*, Vol. 25, pp. 613-(1995) compares various processes for electrolytically yielding hydrogen peroxide. In each of these processes, hydrogen peroxide is efficiently obtained in an atmosphere of an aqueous alkali solution. It is therefore indispensable to use an aqueous solution of an alkali such as KOH or NaOH because of the necessity of supplying an alkali ingredient as a feed material. Formaldehyde decomposition as an example of the decomposition of organic substances with hydrogen peroxide is described in *Journal of Electrochemical Society*, Vol. 140, pp. 1632-(1993). Furthermore, a technique in which pure water as a raw material is electrolyzed using an ion-exchange membrane to synthesize ozone and hydrogen peroxide on the anode and cathode, respectively, is proposed in *Journal of Electrochemical Society*, Vol. 141, pp. 1174-(1994). However, these techniques are impractical because the current efficiency is low. Although a technique in which a similar method is conducted at high pressure to thereby heighten efficiency has been proposed, this technique is also impractical from the standpoint of stability. Moreover, an electrolytic method using a palladium foil has been proposed. However, this method is only useful in limited applications because the hydrogen peroxide concentration obtained is low and the method is costly.

In the treatment of tap water, well water, seawater, or other water containing multivalent metal ions in a large amount, there are cases where a hydroxide deposits on the cathode surface to give rise to problems such as, e.g., the inhibition of power feeding. For avoiding such problems, it is necessary to treat the water, e.g., tap water, to be supplied to an electrolytic cell with electrodialysis or a reverse osmosis membrane to diminish the multivalent metal ions, or to periodically clean the electrolytic cell main body with, e.g., an acid to remove the deposit. The levels of multivalent metal ions are 1 to 10 ppm for tap water, 1 to 100 ppm for well (ground) water and 500 to 5,000 ppm for sea water, respectively.

When feed water having a low electrolyte concentration as in soft water is used for electrolytically producing hydrogen peroxide, the current density is low and this method is hence unsuitable for the production of a large amount of hydrogen peroxide. In addition, an increased load is imposed on the electrodes, resulting in a shortened electrode life.

SUMMARY OF THE INVENTION

It is therefore an object of the present invention to meet the desire for a practical electrolytic cell capable of producing hydrogen peroxide at high efficiency over long period of operation.

The above object of the invention is achieved by providing an electrolytic cell for hydrogen peroxide production which comprises an electrolytic cell main body having an anode and a cathode both disposed therein and in which electrolysis is conducted while supplying to the electrolytic cell main body an oxygen-containing gas and a feed water containing at least one salt dissolved therein in a low concentration to thereby produce hydrogen peroxide. The invention further provides a process for producing hydrogen peroxide which comprises: converting a starting water containing multivalent metal ions into a feed water which is a low-concentration salt solution containing univalent metal ions by removing the multivalent metal ions from the starting water; and conducting electrolysis in an electrolytic cell main body partitioned into an anode chamber and a cathode chamber with a diaphragm while supplying the feed water and an oxygen-containing gas to the cathode chamber to produce hydrogen peroxide.

BRIEF DESCRIPTION OF THE DRAWING

The foregoing and other aims and advantages of the invention will be apparent from the following detailed description and the accompanying drawing, in which The FIGURE is a vertical sectional view illustrating an example of an electrolytic cell for use in the process of the invention.

DETAILED DESCRIPTION OF THE INVENTION

Figure 1:
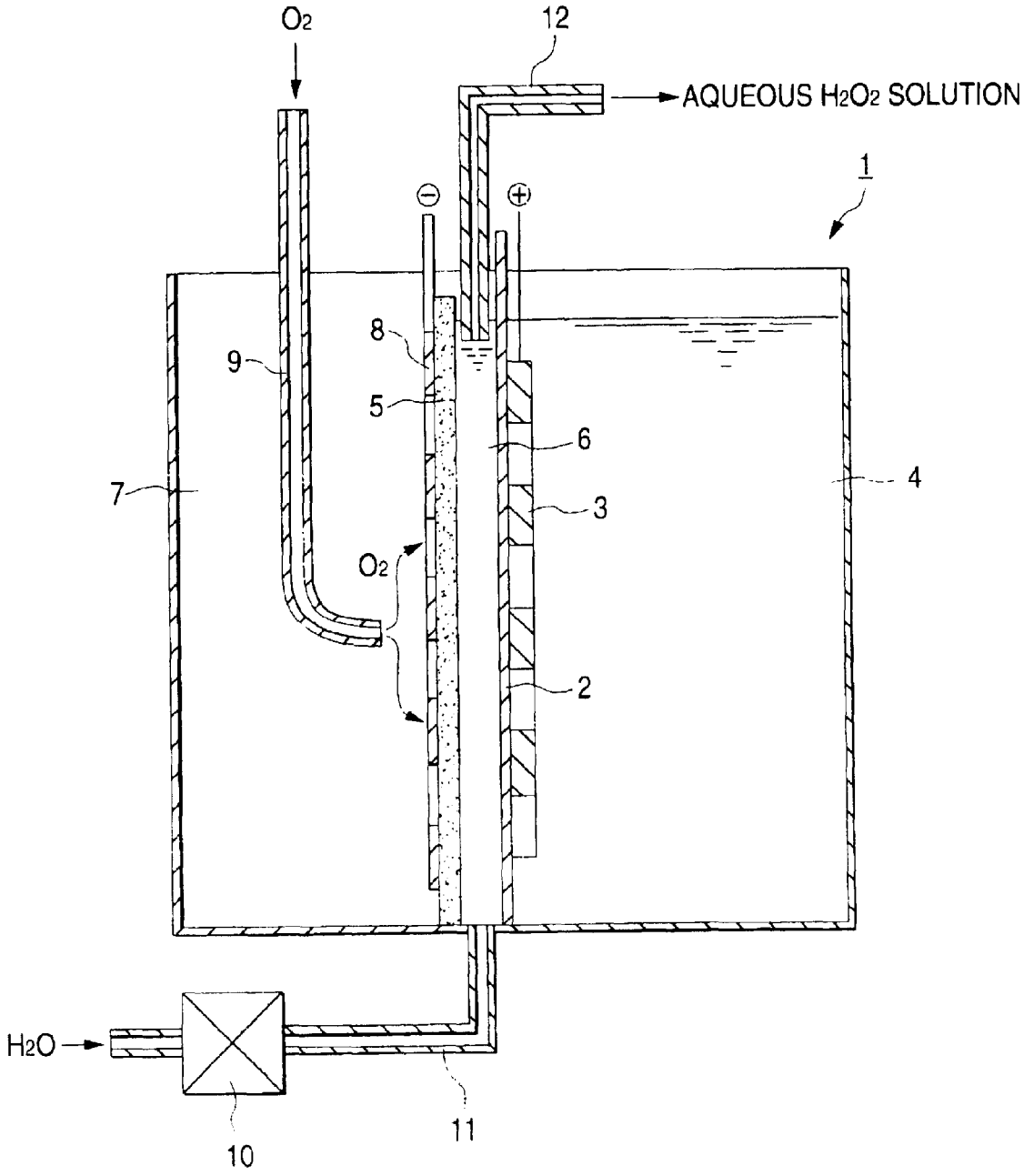

In the invention, a feed water containing at least one salt dissolved therein in low concentration is used as an electrolytic solution to produce hydrogen peroxide. Since this feed water used as an electrolytic solution has a moderate ionic concentration, hydrogen peroxide can be produced at a sufficient current density. Furthermore, even when the electrolyte remains in the aqueous hydrogen peroxide solution thus obtained, it exerts almost no adverse influence.

In the electrolytic production of hydrogen peroxide by cathodic reduction of oxygen, the anodic reactions and cathodic reaction are as follows.

Anodic reactions:

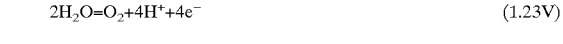

$$2H_2O=O_2+4H^++4e^- \quad (1.23V)$$

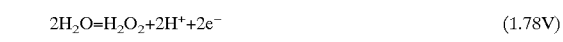

$$3H_2O=O_3+6H^++6e^- \quad (1.51V)$$

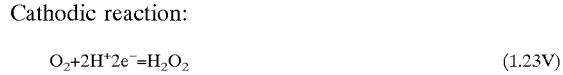

$$2H_2O=H_2O_2+2H^++2e^- \quad (1.78V)$$

Cathodic reaction:

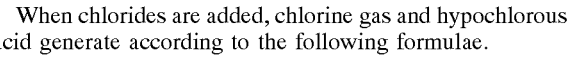

$$O_2+2H^+2e^-=H_2O_2 \quad (1.23V)$$

When chlorides are added, chlorine gas and hypochlorous acid generate according to the following formulae.

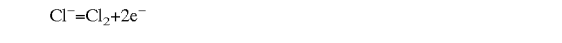

$$Cl^-=Cl_2+2e^-$$

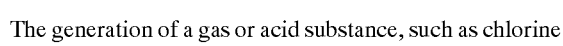

$$Cl_2+H_2O=HCl+HClO$$

The generation of a gas or acid substance, such as chlorine gas or hypochlorous acid, necessitates a gas treatment or poses a problem such as cathode deterioration. When water containing a chloride is electrolyzed, there are cases where a trihalomethane (THM), which is harmful is generated in addition to chlorine gas and hypochlorous acid.

These problems can be eliminated by using an electrode which is less apt to yield chlorine gas, hypochlorous acid, or a THM, such as a manganese dioxide type electrode (e.g., $MnO_2$, Mn—V—$O_x$, Mn—Mo—$O_x$, or Mn—V—$O_x$), as an anode catalyst. When this electrode is used, water electrolysis (oxygen generation) occurs preferentially even in the presence of chloride ions and the generation of chlorine gas or hypochlorous acid is inhibited. Alternatively, the above problems may be avoided by minimizing the concentration of chloride ion in the anolyte present in the anode chamber, i.e., by maintaining a chloride ion concentration of 1 g/L or lower. In the case where sufficient conductivity cannot be obtained at this concentration, another metal salt may be added.

Addition of sulfates may result in the generation of persulfuric acid depending on the electrolysis conditions. However, this persulfuric acid does not adversely influence hydrogen peroxide generation.

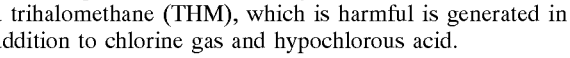

$$2SO_4^{2-}=S_2O_8^{2-}$$

Addition of acetates may result in the generation of carbon dioxide besides oxygen depending on the electrode material.

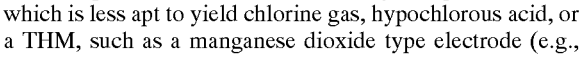

$$CH_3COOH+2H_2O=2CO_2+8H^+8e^-$$

It is known that the amount of oxidation products formed from those salts is generally considerably small as compared with the amount of oxidation products formed from chlorides.

Carbonates are desirable in that they impart conductivity to the feed water. However, since carbonates precipitate as sodium carbonate, potassium carbonate, etc., on a cathode placed in an alkaline atmosphere, the use of a carbonate in an electrolysis cell having no diaphragm or dissolution of a carbonate in the catholyte for use in an electrolysis cell having a diaphragm should be avoided. It is advantageous to dissolve a carbonate in the anolyte for use in an electrolysis cell having a diaphragm.

The feed water for use in the invention is not particularly limited in kind, and tap water, well water, seawater, and other types of water can be used. These feed waters, when used without any treatment, have a resistance loss which is not negligible as compared with the cell voltage. In addition, since the low conductivity results in a limited area effective for electrode reactions, a salt is added to heighten the conductivity as described above. Examples of salts which can be dissolved therein include sodium sulfate, potassium sulfate, sodium chloride, potassium chloride, and sodium acetate. Such salts are dissolved in a concentration of desirably from 0.001 to 0.1 M. When the concentration of the dissolved salt is lower than 0.001 M, sufficient effects are not produced by the addition, often resulting in an increased cell voltage and no prolongation of electrode life. Concentrations thereof exceeding 0.1 M are disadvantageous in that the salt cost is too high and the water which has been thus treated has an increased residual-salt concentration which interfaces with water quality.

Softening a water such as, e.g., tap water or well water results in the generation of hypochlorous acid because sodium chloride or potassium chloride is dissolved therein in a minute amount. Although use of softened water can introduce the problem described above, the amount of the hypochlorous acid which is generated is considerably reduced by dissolving a salt in a concentration in the range shown above.

In case the where a feed water containing a large amount of multivalent metal ions is used, a hydroxide or carbonate may precipitate on the cathode surface with the progress of electrolysis to inhibit the electrolysis reaction. This can be avoided by removing the multivalent metal ions before the salt dissolution.

In the invention, all of the feed water corresponding to the desired amount of hydrogen peroxide to be generated need not be supplied to the solution chamber of the electrolytic cell. Namely, a large amount of an aqueous hydrogen peroxide solution can be produced in the following manner. A flow of the feed water is branched into two lines. A salt is dissolved in one of the branches. This salt-containing branch is electrolyzed to yield hydrogen peroxide and thereby obtain an aqueous hydrogen peroxide solution, which is mixed and diluted with the other branch. Thus, an aqueous hydrogen peroxide solution having a given concentration is obtained.

The electrolytic cell for use in the invention is not particularly limited as long as it is for use in hydrogen peroxide production. For example, the following electrolytic cell can be used.

The anode is preferably an insoluble anode. A manganese dioxide-based electrode such as those shown above may be used according to the kind of the salt to be dissolved.

Examples of anode catalysts for the insoluble anode which are capable of being stably used include noble metals such as iridium, platinum, and ruthenium, oxides of these noble metals, and mixed oxides containing an oxide of a value metal such as titanium or tantalum. Also usable are lead oxide, tin oxide, carbon, and the like. In the case of using a chloride, it is desirable to select a catalyst so that the oxygen-yielding reaction which is a water oxidation reaction occurs preferentially to the generation of chlorine gas or hypochlorous acid by chlorine ion oxidation. Manganese dioxide and mixed oxides such as manganese-vanadium, manganese-molybdenum, and manganese-tungsten oxides are known to inhibit the discharge of chloride ions (generation of chlorine gas). Such an anode catalyst can be deposited on the surface of an electrode base, e.g., titanium, in an amount of from 1 to 1,000 g/m$^2$ by a method comprising immersing the base in an aqueous solution containing, dissolved therein, ions of the components of the catalyst. The catalyst may be used alone in a platy form or may be deposited in an amount of from 1 to 500 g/m$^2$ on a substrate, e.g., a plate, metal gauze, powder sinter, or metal fiber sinter, made of a corrosion-resistant material such as, e.g., titanium, niobium, or tantalum by a pyrolytic method, adhesion with a resin, composite plating, etc. As a feeder for the anode, a valve metal such as titanium or an alloy thereof can be used.

When a current is caused to flow, the electrode and the feeder are consumed over time according to the current density even when the above expensive materials are used. Graphite and amorphous carbon are severely consumed. A conductive diamond electrode was recently proposed as an electrode which is inactive in water decomposition reactions and can yield, in oxidation reactions, ozone and hydrogen peroxide besides oxygen (see *Journal of the Electrochemical Soc.*, Vol. 145, pp.2358-(1998)). This conductive diamond electrode also can be used in the invention. Hydrogen peroxide and ozone are sources of OH radicals, which have a higher oxidizing power. When a conductive diamond electrode is used, hydrogen peroxide and ozone are generated and OH radicals generate therefrom.

The cathode is preferably an oxygen gas diffusion electrode. With this cathode, hydrogen peroxide is efficiently produced by the reduction of oxygen gas.

The oxygen gas diffusion electrode preferably employs a metal such as gold, a metal oxide, or carbon such as graphite or conductive diamond as a catalyst. Such catalysts may be coated with an organic material such as polyaniline or a thiol (organic compound containing —SH). The catalyst may be used alone in a platy or porous form or may be deposited in an amount of from 1 to 1,000 g/m$^2$ on a substrate, e.g., a plate, metal gauze, powder sinter, or metal fiber sinter, made of a corrosion-resistant material such as, e.g., stainless steel, zirconium, silver, or carbon by a pyrolytic method, adhesion with a resin, composite plating, etc. Formation of a hydrophobic sheet on the cathode on its side opposite the anode is effective in controlling gas supply to the reaction surface.

As a feeder for the cathode, carbon, a metal such as, e.g., nickel, stainless steel, or titanium, or an alloy or oxide thereof can be used. Such a feeder is preferably used in a porous or sheet form. For the purpose of smoothly supplying a feed water and smoothly discharging the gases produced by the reactions and the water which has undergone electrolysis, it is desirable to scatteringly deposit a hydrophobic or hydrophilic material on the feeder surface.

In the case where the conductivity of the catholyte remains low even after a salt has been dissolved therein, the cell voltage is increased or the electrode life is shortened. In this case, it is desirable to employ a structure in which the oxygen gas diffusion cathode is disposed as close as possible to the ion-exchange membrane (the width of the solution chamber is reduced) for the purpose of preventing contamination by the gas diffusion electrode material and for other purposes.

The amount of oxygen to be supplied to the cathode is preferably about from 1 to 2 times the theoretical amount. The oxygen source may be a commercial oxygen bomb. Alternatively, oxygen generated by water electrolysis in an electrolytic cell separately installed or oxygen obtained from air by concentration with a PSA (pressure swing adsorption) apparatus may be used. In general, the higher the oxygen concentration, the higher the current density at which hydrogen peroxide can be produced.

By using a diaphragm for partitioning the electrolytic cell main body into an anode chamber and a cathode chamber, the active substances produced by electrode reactions can be stably held without coming into contact with the respective counter electrodes. Furthermore, even when the water to be electrolyzed has a low conductivity, electrolysis can be caused to proceed speedily. As the diaphragm, a neutral diaphragm or an ion-exchange membrane can be used. Especially when chloride ion is used, a cation-exchange membrane is preferred in order to prevent, e.g., hypochlorite ion produced by oxidation of chloride ion on the anode from coming into contact with the cathode. Examples of the diaphragm material include fluororesins and hydrocarbons. From the standpoint of corrosion resistance, the former is preferred.

As a solid porous material having an ion-exchanging ability, commercial ion-exchange resin particles can be used. Although hydrocarbon resins such as styrene, acrylic, and aromatic polymers are available, the use of a fluororesin material is preferred from the standpoint of corrosion resistance. It is also possible to deposit an ingredient having an ion-exchanging ability on an appropriate porous supporting member. The porosity of the material is desirably from 20 to 90% from the standpoints of even liquid dispersion and resistivity. The size of the pores or material particles is preferably from 0.1 to 10 mm.

Preferred electrolysis conditions include a liquid temperature of from 5 to 60° C. and a current density of from 0.1 to 100 A/dm$^2$. Although the distance between the electrodes should be small so as to reduce the resistance loss, it is preferably from 1 to 50 mm from the standpoints of reducing pressure loss for the pump for feeding an electrolytic solution and for maintaining an even pressure distribution.

The material of the electrolytic cell is preferably a glass-lined material, carbon, a highly corrosion-resistant material such as titanium or stainless steel, a PTFE resin, or the like from the standpoints of durability and hydrogen peroxide stability. The concentration of hydrogen peroxide thus produced can be regulated to a value in the range of from 10 to 10,000 ppm (1 wt %) by regulating the water feed rate and the current density.

DETAILED DESCRIPTION OF THE PREFERRED EMBODIMENT

An embodiment of a preferred electrolytic cell for use in the process for producing an aqueous hydrogen peroxide solution according to the invention will be explained below in detail by reference to the accompanying FIGURE. However, the present invention should not be construed as being limited thereto.

The FIGURE is a vertical sectional view illustrating an embodiment of an electrolytic cell suitable for use in the production of an aqueous hydrogen peroxide solution according to the process of the invention.

Electrolytic cell 1 is a two-chamber electrolytic cell which has been partitioned with a cation-exchange membrane 2 into an anode chamber 4 having a porous platy anode 3 in intimate contact with the ion-exchange membrane 2 and a cathode chamber having an oxygen gas diffusion cathode 5. The cathode chamber is partitioned by the oxygen gas diffusion cathode 5 into a solution chamber 6 located on the side facing the ion-exchange membrane and a gas chamber 7 on the opposite side.

A voltage is applied to the oxygen gas diffusion cathode 5 through a porous feeder 8 in intimate contact with the back side of the cathode 5. An oxygen-containing gas is fed to the cathode 5 through an oxygen-containing-gas feed pipe 9 disposed on the back side thereof.

To the bottom of the solution chamber 6 is connected a catholyte feed pipe 11, which in an upstream part thereof has a device 10 for removing multivalent metal ions and dissolving a salt in a low concentration. The device 10 removes multivalent metal ions such as magnesium and calcium from tap water and dissolves a salt of a univalent metal, e.g., sodium sulfate, in the water in a low concentration. This aqueous solution is fed to the solution chamber 6 through the catholyte feed pipe 11. A typical means for treating the water containing multivalent metal ions is a commercially available softener.

The oxygen-containing gas fed through the oxygen-containing gas feed pipe 9 passes through the oxygen gas diffusion cathode 5, during which the gas is partly reduced by the electrode catalyst into hydrogen peroxide. This gas then reaches the solution chamber 6 and the hydrogen peroxide dissolves in the electrolytic solution, which is taken out of the electrolytic cell as an aqueous hydrogen peroxide solution.

In this electrolytic production of hydrogen peroxide, the catholyte present in the solution chamber 6 contains a salt of a univalent metal in a low concentration that is still sufficient to secure a quantity of electricity necessary for the electrolysis. Because of this, hydrogen peroxide is generated by water hydrolysis at an appropriate current density. The hydrogen peroxide dissolves in the catholyte, and the resultant aqueous hydrogen peroxide solution is discharged from the cathode chamber.

In addition, since the metal salt is a salt of a univalent metal such as sodium or potassium, it does not deposit as a hydroxide on the cathode surface during the electrolysis operation. Consequently, hydrogen peroxide can be continuously produced without the necessity of discontinuing the voltage application to remove deposits.

EXAMPLES

Examples of the production of an aqueous hydrogen peroxide solution according to the invention will be given below. However, these Examples should not be construed as limiting the scope of the invention.

Example 1

An iridium oxide catalyst was deposited onto a porous titanium plate by a pyrolytic method in an amount of 10 $g/m^2$ to obtain an anode.

A graphite powder (TGP-2, manufactured by Tokai Carbon Co., Ltd.) was kneaded together with a PTFE resin. The resultant mixture was formed into a sheet and burned at 330° C. to obtain a 0.5 mm-thick sheet. This sheet as an oxygen gas diffusion cathode was united with a cathode feeder consisting of a porous graphite plate having a thickness of 5 mm.

The anode was placed into intimate contact with an ion-exchange membrane (Nafion 117, manufactured by E.I. du Pont de Nemours & Co.). The feeder-bearing oxygen gas diffusion cathode was disposed so as to result in an electrode spacing of 3 mm to fabricate an electrolytic cell having the structure shown in the FIGURE which had a height of 25 cm and an area effective for electrolysis of 125 $cm^2$.

On the other hand, tap water was softened with an ion-exchange membrane, and sodium sulfate was dissolved therein in a concentration of 0.003 M to prepare an electrolytic feed solution having a conductivity of 1 mS/cm.

This feed solution was supplied to the anode chamber and the solution chamber at a rate of 10 ml/min and air was fed to the gas chamber at a rate of 500 ml/min. While thus supplying these feed materials, a current of 6.3 A was passed through the electrolytic cell at a temperature of 25° C. As a result, the cell voltage was 14 V and an aqueous hydrogen peroxide solution having a hydrogen peroxide concentration of about 5,000 ppm was obtained through the outlet from the solution chamber at a current efficiency of about 80%.

This electrolytic production of hydrogen peroxide was continued for 6,000 hours. As a result, the current efficiency and the hydrogen peroxide concentration decreased to about 75% and about 4,700 ppm, respectively. However, the operation could still be continued.

Example 2

An electrolytic cell was fabricated under the same conditions as in Example 1, except that the ion-exchange membrane was omitted. While the aqueous sodium sulfate solution prepared in Example 1 continued to be supplied to the electrolytic cell (to the region corresponding to the anode chamber and solution chamber in Example 1) at a rate of 20 ml/min, a current of 6.3 A was passed through the electrolytic cell at a temperature of 25° C. As a result, the cell voltage was 12 V and an aqueous hydrogen peroxide solution having a hydrogen peroxide concentration of about 2,500 ppm was obtained through the outlet from the electrolytic cell at a current efficiency of about 40%.

This electrolytic production of hydrogen peroxide was continued for 6,000 hours. As a result, the current efficiency and the hydrogen peroxide concentration decreased to about 30% and about 2,000 ppm, respectively. However, the operation could still be continued.

Example 3

An electrolytic cell was fabricated under the same conditions as in Example 1, except that a manganese dioxide electrode was used as an anode.

Tap water was softened with an ion-exchange membrane, and sodium chloride was dissolved therein in a concentration of 0.007 M to prepare an electrolytic feed solution having a conductivity of about 1 mS/cm.

This feed solution was supplied to the anode chamber and the solution chamber at a rate of 10 ml/min and air was fed to the gas chamber at a rate of 500 ml/min. While thus supplying these feed materials, a current of 6.3 A was passed through the electrolytic cell at a temperature of 25° C. As a result, the cell voltage was 12 V and an aqueous hydrogen peroxide solution having a hydrogen peroxide concentration of about 5,000 ppm was obtained through the outlet from the solution chamber at a current efficiency of about 80%. In the anode chamber, effective chlorine compounds including hypochlorite ion were produced at a current efficiency of 0.05%.

This electrolytic production of hydrogen peroxide was continued for 3,000 hours. As a result, the current efficiency and the hydrogen peroxide concentration decreased to about 60% and about 4,400 ppm, respectively. However, the operation could still be continued.

Example 4

An electrolytic cell was fabricated and electrolysis was conducted at a current of 6.3 A under the same conditions as in Example 1, except that Yumicron having a thickness of 0.3 mm (manufactured by Yuasa Corp.) was used in place of the Nafion 117, manufactured by E.I. du Pont de Nemours & Co, used as a diaphragm in Example 1. As a result, the cell voltage was 13 V and an aqueous hydrogen peroxide solution having a hydrogen peroxide concentration of about 5,000 ppm was obtained through the outlet from the solution chamber at a current efficiency of about 80%.

This electrolytic production of hydrogen peroxide was continued for 6,000 hours. As a result, the current efficiency and the hydrogen peroxide concentration decreased to about 70% and about 4,400 ppm, respectively. However, the operation could still be continued.

Example 5

An electrolytic cell (the anode was an iridium oxide-coated titanium plate) was fabricated and electrolysis was conducted at a current of 6.3 A under the same conditions as in Example 1, except that the 0.007 M sodium chloride solution used in Example 3 was supplied as a feed solution to the anode chamber and the solution chamber at a rate of 10 ml/min. As a result, the initial cell voltage was 14 V and an aqueous hydrogen peroxide solution having a hydrogen peroxide concentration of about 5,000 ppm was obtained through the outlet from the solution chamber at a current efficiency of about 80%. In the anode chamber, effective chlorine compounds including hypochlorite ion were produced at a current efficiency of about 5%.

This electrolytic production of hydrogen peroxide was continued for 500 hours. As a result, the cell voltage increased to 16 V. Although the current efficiency and the hydrogen peroxide concentration decreased to about 60% and about 3,800 ppm, respectively, the operation could be continued.

Comparative Example 1

An electrolytic cell was fabricated and electrolysis was conducted at a current of 6.3 A under the same conditions as in Example 1, except that an electrolytic feed solution (sodium chloride concentration, 0.0007 M; conductivity, about 0.1 mS/cm) was used, prepared by softening tap water with an ion-exchange membrane without adding a salt thereto. As a result, the initial cell voltage was 50 V and an aqueous hydrogen peroxide solution having a hydrogen peroxide concentration of about 1,000 ppm was obtained through the outlet from the solution chamber at a current efficiency of about 20%. However, the electrolysis immediately could not be continued. The electrolytic cell was disassembled and, as a result, the electrodes were found to have been partly consumed and deteriorated.

The electrolytic cell for hydrogen peroxide production of the invention is an electrolytic cell which comprises an electrolytic cell main body having an anode and a cathode disposed therein, and in which electrolysis is conducted while supplying an oxygen-containing gas and feed water containing at least one salt dissolved therein in a low concentration to thereby produce hydrogen peroxide.

Due to the salt dissolution, the feed water used as an electrolytic solution has a moderate ionic concentration and, hence, hydrogen peroxide can be electrolytically produced at a sufficient current density. Furthermore, even when the electrolyte remains in the aqueous hydrogen peroxide solution thus obtained, it exerts little adverse effect. The preferred range of the salt concentration is from 0.001 to 0.1 M.

The salt is desirably at least one member selected from the group consisting of chlorides, sulfates, nitrates, and acetates of univalent metals. In the case of using a chloride, the electrolytic cell is desirably designed so that the cathode has a catalyst which inhibits the electrolytic oxidation of the chloride.

The oxygen-containing gas is preferably air because of it is inexpensive. However, in the case where the carbon dioxide contained in the air accelerates carbonate deposition on the cathode surface, the carbon dioxide is preferably removed beforehand.

Partitioning the electrolytic cell main body into an anode chamber and a cathode chamber with a diaphragm is effective, e.g., in preventing the hydrogen peroxide thus generated from being decomposed by contact with the anode and in preventing the cathode from being deteriorated by chloride ion present on the anode chamber side.

When the feed water contains multivalent metal ions, the multivalent metal ions are removed before a salt of a univalent metal is dissolved in the feed water. Thus, the electrolytic solution to be electrolyzed is free from multivalent metal ions.

It should further be apparent to those skilled in the art that various changes in form and detail of the invention as shown and described above may be made. It is intended that such changes be included within the spirit and scope of the claims appended hereto.

This application is based on Japanese Patent Application No. 2001-120063 filed Apr. 18, 2001, the disclosure of which is incorporated herein by reference in its entirety.

What is claimed is:

1. An electrolytic cell for hydrogen peroxide production, which comprises an electrolytic cell having an anode and a cathode therein, means for supplying to the electrolytic cell an oxygen-containing gas and a feed water containing at least one salt selected from the group consisting of chlorides, sulfates, nitrates and acetates of a univalent metal dissolved therein in a concentration of from 0.001 to 0.1 M, and means for conducting electrolysis while supplying said oxygen-containing gas and feed water to thereby produce hydrogen peroxide, said electrolytic cell comprising a diaphragm partitioning the electrolytic cell into an anode chamber including the anode and a cathode chamber including an oxygen gas diffusion cathode, said oxygen gas diffusion cathode partitioning said cathode chamber into a gas chamber and a solution chamber positioned between the gas chamber and the diaphragm, said electrolytic cell comprising means for supplying an oxygen-containing gas to said oxygen gas diffusion cathode and feed water to said solution chamber, and an outlet for recovering hydrogen peroxide solution from said solution chamber.

2. The electrolytic cell as claimed in claim 1, the anode has a catalyst which inhibits the electrolytic oxidation of chlorides.

3. The electrolytic cell as claimed in claim 1, wherein said means for supplying comprising means for supplying air to said oxygen diffusion cathode.

4. The electrolytic cell as claimed in claim 1, wherein said feed water substantially does not contain multivalent metal ions.

5. The electrolytic cell as claimed in claim 1, further comprising means for removing multivalent metal ions from the feed water.

6. A process for producing hydrogen peroxide, which comprises:

treating water containing multivalent metal ions to remove said multivalent metal ions and to provide a feed water which is a salt solution selected from the group consisting of chlorides, sulfates, nitrates and acetates of a univalent metal having a concentration of from 0.001 to 0.1 M; and conducting electrolysis in an electrolytic cell partitioned into an anode chamber and a cathode chamber with a diaphragm while supplying the feed water and an oxygen-containing gas to the cathode chamber to produce hydrogen peroxide, said electrolytic cell comprising a diaphragm partitioning the electrolytic cell into an anode chamber including the anode and a cathode chamber including an oxygen gas diffusion cathode, said oxygen gas diffusion cathode partitioning said cathode chamber into a gas chamber and a solution chamber positioned between the gas chamber and the diaphragm, said electrolytic cell comprising means for supplying an oxygen-containing gas to said oxygen gas diffusion cathode and feed water to said solution chamber, and an outlet for recovering hydrogen peroxide solution from said solution chamber.

7. The process as claimed in claim 6, wherein anode has a catalyst which inhibits the electrolytic oxidation of chlorides.

8. The process as claimed in claim 6,wherein said means for supplying comprises supplying air to said oxygen gas diffusion cathode.

9. The process as claimed in claim 6, wherein said feed water substantially does not contain multivalent metal ions.

10. The process as claimed in claim 6, wherein the electrolytic cell comprises means for removing multivalent metal ions from the feed water.

* * * * *